US005674083A

United States Patent [19]

Whiteman, Jr. et al.

[11] Patent Number: 5,674,083

[45] Date of Patent: Oct. 7, 1997

[54] ESD PROTECTED ELECTRICAL CONNECTOR

[75] Inventors: Robert Neil Whiteman, Jr., Middletown; Scott Stuart Smith, Mechanicsburg, both of Pa.

[73] Assignee: The Whitaker Corporation, Wilmington, Del.

[21] Appl. No.: 561,648

[22] Filed: Nov. 22, 1995

[51] Int. Cl.[6] ..... H01R 13/53

[52] U.S. Cl. ..... 439/181; 439/103

[58] Field of Search ..... 439/101–103, 439/108, 181, 607, 608

[56] References Cited

U.S. PATENT DOCUMENTS

| | | | |
|---|---|---|---|
| 3,867,670 | 2/1975 | Schor et al. | 317/61.5 |
| 3,867,671 | 2/1975 | Johnson | 317/61.5 |
| 4,156,161 | 5/1979 | Pittman | 313/325 |
| 4,179,178 | 12/1979 | Bachman et al. | 339/111 |
| 4,458,291 | 7/1984 | Yanagisawa et al. | 361/212 |
| 4,477,134 | 10/1984 | Wright | 339/17 F |
| 4,531,176 | 7/1985 | Beecher, II | 361/424 |
| 4,532,419 | 7/1985 | Takeda | 235/492 |
| 4,568,133 | 2/1986 | Amano et al. | 339/14 R |
| 4,601,527 | 7/1986 | Lemke | 339/14 R |
| 4,673,236 | 6/1987 | Musolff et al. | 439/609 |
| 4,688,868 | 8/1987 | Noyes | 439/108 |
| 4,699,438 | 10/1987 | Kikuta | 439/95 |
| 4,711,506 | 12/1987 | Tanaka | 439/108 |
| 4,737,116 | 4/1988 | Slye et al. | 439/92 |
| 4,781,623 | 11/1988 | Philipson et al. | 439/610 |
| 4,824,377 | 4/1989 | De Burro | 439/186 |
| 4,828,506 | 5/1989 | Tuckwood | 439/181 |
| 4,889,497 | 12/1989 | Riches | 439/76 |
| 4,889,502 | 12/1989 | Althouse et al. | 439/607 |
| 4,925,400 | 5/1990 | Blair et al. | 439/374 |
| 5,066,240 | 11/1991 | Verdun | 439/181 |
| 5,161,991 | 11/1992 | Bauer | 439/181 |
| 5,256,074 | 10/1993 | Tan et al. | 439/108 |
| 5,259,772 | 11/1993 | Fusselman et al. | 439/108 |
| 5,281,155 | 1/1994 | Comerci et al. | 439/107 |
| 5,478,253 | 12/1995 | Biechler et al. | 439/181 |

FOREIGN PATENT DOCUMENTS

| | | |
|---|---|---|
| 0 006 100 | 1/1980 | European Pat. Off. . |
| 0 180 284 A3 | 5/1986 | European Pat. Off. . |
| E 74473 B | 9/1992 | Germany . |
| 1437998 | 6/1976 | United Kingdom . |

OTHER PUBLICATIONS

U.S. Patent Application Serial No. 07/977,800 filed Nov. 17, 1992 (Abstract and Drawings only included).

U.S. Patent Application Serial No. 07/994,669 filed Dec. 22, 1992 (Abstract and Drawings only included).

International Search Report mailed Apr. 2, 1997, PCT/US96/18409, three pages.

*Primary Examiner*—Khiem Nguyen

*Attorney, Agent, or Firm*—Anton P. Ness

[57] ABSTRACT

An electrical connector (10) having an array of contacts (14) in housing (12), and including a conductive member (50) affixed to the housing to be nonengagingly adjacent the contacts and define spark gaps (80) therebetween such as at protrusions (58) along body section (52) of the conductive member (50). Board-mounting sections (56) extend from the conductive member and be received into mounting holes (36) of a circuit element (30) to establish a chassis ground connection, thereby establishing a continuing ESD arrangement for protection of circuits and components of an electronic apparatus when connected to another apparatus at an input/output port, and even when unmated.

11 Claims, 5 Drawing Sheets

ESD PROTECTED ELECTRICAL CONNECTOR

FIELD OF THE INVENTION

The present invention relates to the field of electrical connectors, and more particularly to connectors having protection against electrostatic potential discharge (ESD).

BACKGROUND OF THE INVENTION

Certain electrical connectors are used in environments where an electrostatic potential commonly develops between the apparati to which each of a matable pair of electrical connectors is mounted, with damaging consequences to sensitive electronic components of the apparati upon uncontrolled discharge of this potential if the potential is great enough. An example of this is concerned with an electronic apparatus such as a television set to which a peripheral apparatus is to be electrically connected by means of a cable harness at an input/output port of the set; discharge of the potential can occur along signal lines upon mating of the cable and port connectors, with the surge possibly capable of damaging the electronic components to which the signal lines lead.

It is desired to provide a mechanism that assuredly guides the discharge of electrostatic potential to chassis ground for harmless dissipation.

SUMMARY OF THE INVENTION

The electrical connector of the present invention includes a plurality of contacts secured in a dielectric housing to extend from a mating face to an opposed mounting face to be mounted to a circuit element such as a circuit board or the like, with exposed contact sections at least at the mounting face for being electrically connected to circuits of the board. A conductive portion of the connector is provided such as a conductive member affixed to the connector, to be spaced slightly from all contacts to define spark gaps, and includes a portion adapted to be connected to a ground circuit of the circuit element to discharge ESD on a continuing basis after the connector is mated to another connector such as a cable connector of a cable of another electronic unit. Further, the present invention when mounted at the input/output port of an electronic apparatus and connected to chassis ground, provides ESD protection to the apparatus even when unmated to a mating connector, especially important when such a connector has no ground shield surrounding the dielectric housing and the signal contacts are particularly susceptible to receipt of ESD from another body.

In a preferred embodiment, the conductive member is affixed to the mounting face and has a body section extending transversely between board-mounting sections at respective ends, with the board-mounting sections extending from the mounting face to be received into mounting holes of the circuit board, providing the means for mounting the connector to the circuit element. The body section extends by exposed portions of the contacts, and edges of the body section preferably include protuberances adjacent the contacts and spaced therefrom a selected short distance to act as ESD concentrators that will attract the discharge from all contacts of the connector; the board-mounting sections are electrically connected to a ground path of the circuit board that will transmit the discharge to chassis ground.

It is an objective of the present invention to provide an electrical connector having inherent electrostatic discharge control for protection of components.

It is also an objective to provide the ESD control by providing a conductive portion of the connector adjacent all signal contacts of the connector to define spark gaps therewith, and having a connection to chassis ground to provide continuing ESD protection.

It is another objective to provide a single-piece conductive member for connecting to chassis ground upon positioning of the connector for in-service use.

It is an additional objective for the single-piece conductive member to also serve as a board-mounting device.

An embodiment of the present invention will now be described by way of example with reference to the accompanying drawings.

DETAILED DESCRIPTION OF THE PREFERRED EMBODIMENT

Figure 1:
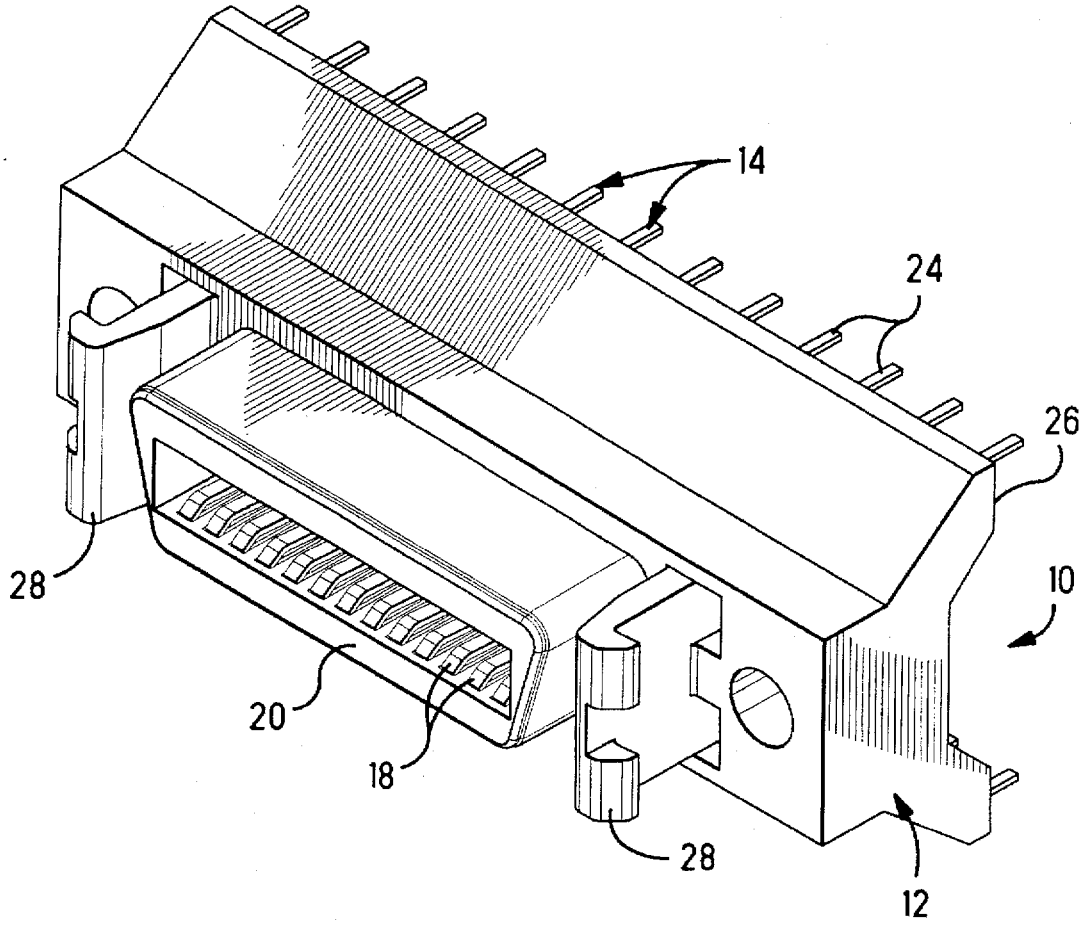
FIGS. 1 and 2 are isometric assembly and exploded views of the connector containing the present invention.
Figure 3:
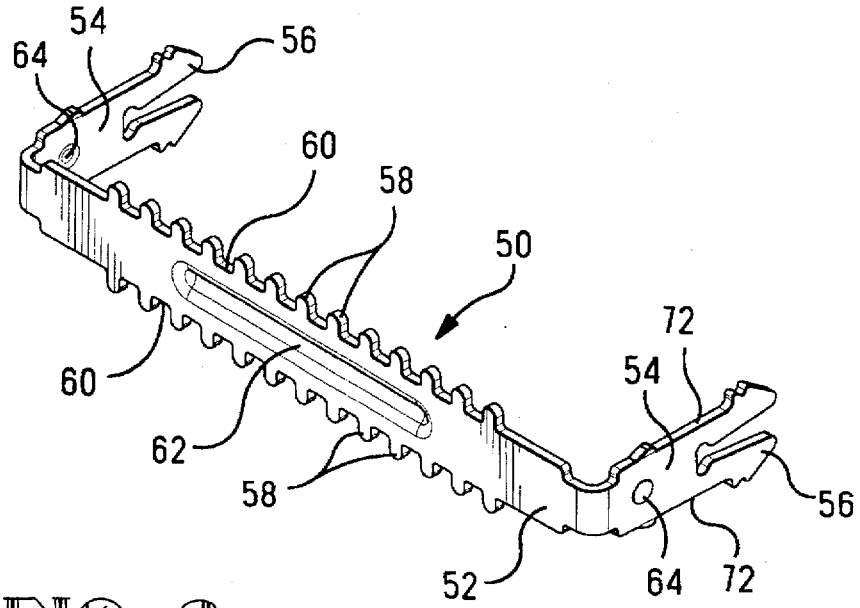
FIG. 3 is a conductive member facilitating innocuous electrostatic discharge in accordance with the present invention.
Figure 2:
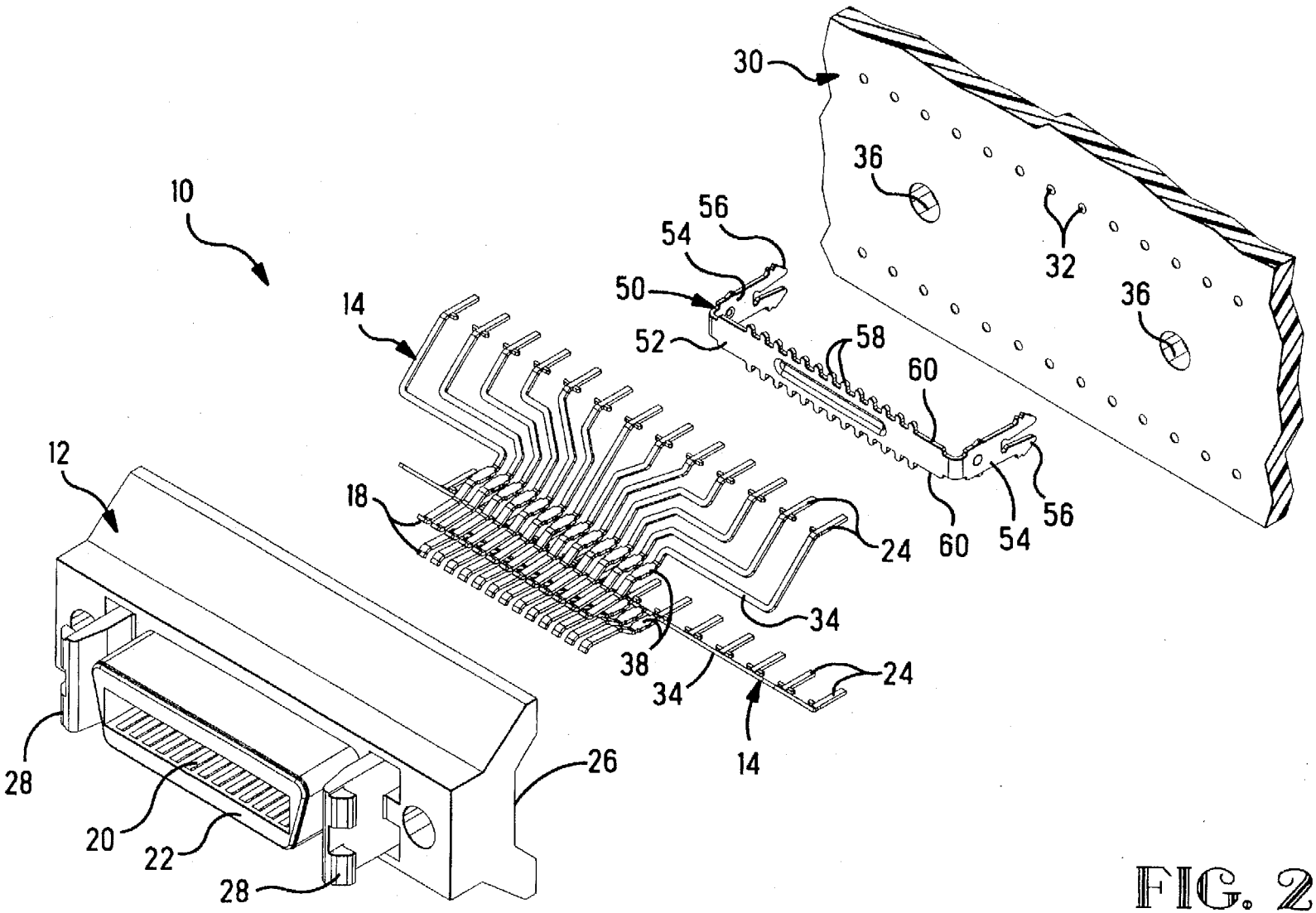
Figure 4:
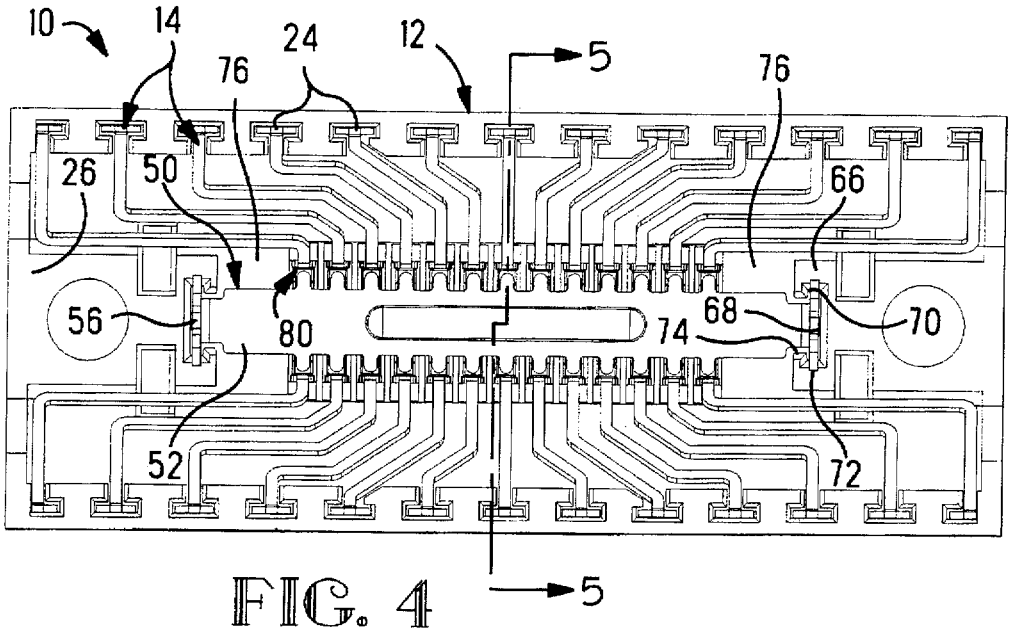
FIG. 4 is a plan view of the board-mounting face of the connector of FIGS. 1 and 2.
Figure 5:
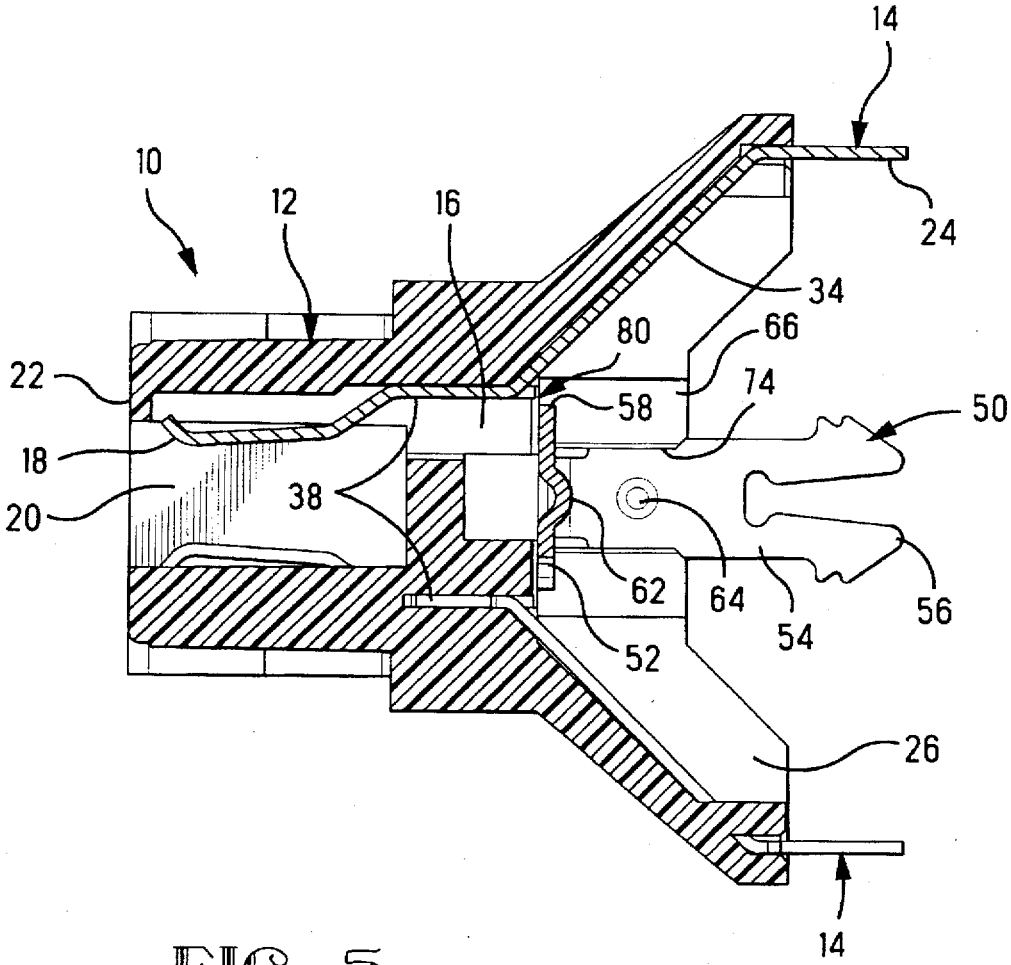
FIG. 5 is a cross-sectional view of the connector taken along lines 5—5 of FIG. 4.

Electrical connector 10 includes a dielectric housing 12 with a two-row array of contacts 14 mounted in respective passageways 16 (FIGS. 4 and 5) and extending from first contact sections 18 exposed in a plug-receiving cavity 20 at connector mating face 22, to second contact sections 24 exposed at connector mounting face 26. Also seen in FIGS. 1 and 2 are latching members 28 for securing connector 10 to a mating connector (not shown). Contacts 14 are arrayed such that first contact sections 18 are positioned in a first two-row arrangement and spacing, and second contact sections 24 are positioned in a second two-row arrangement and spacing and are adapted to be inserted into through-holes 30 of circuit element 32 to provide electrical connections with discrete circuits of the element 30. Contacts 14 include body sections 34 dimensioned and shaped to extend between first and second contact sections 18,24. Body sections 34 include retention sections 38 that cooperate with portions of passageways 16 to establish an interference fit, for retention of contacts 14 within connector 10, such as by being widened to be slightly greater than the passageway dimension thereat while permitting insertion of the narrower portion of the contact to be inserted therepast. Also, second contact sections 24 are shown preferably to include widened portions 40 for retaining second contact sections 24 in precise positions in T-shaped slots 42 of housing 12 (FIGS. 6 to 8), facilitating insertion into through-holes 30 of circuit element 30 during board mounting.

Conductive member 50 of FIGS. 2 to 8 includes a conductive body 52 with tabs 54 extending from ends thereof and concluding in board-mounting sections 56 to be received into mounting holes 36 of circuit element 32 in a force-fit, for retention of connector 10 to circuit element 32. Protrusions 58 are seen provided along side edges 60 of conductive body 52 in the form of teeth, whose purpose will be described below. Preferably an embossment 62 is formed along conductive body 52 for strength.

Referring particularly to FIGS. 4 to 8, flange portions 66 of housing 12 are provided proximate each end of the housing along board-mounting face 24. Flange portions 66 include T-shaped slots 68 having ears 70 associated with side edges 72 of tabs 54 of conductive member 50, and with openings 74 in communication with open area 76 between flange portions 66 for conductive body 52 to extend therethrough into open area 76. Along side surfaces of tabs 54 are provided dome-shaped embossments 64, engageable with opposed side walls of slots 68 into which tabs 54 are inserted to define an interference fit.

Figure 8:
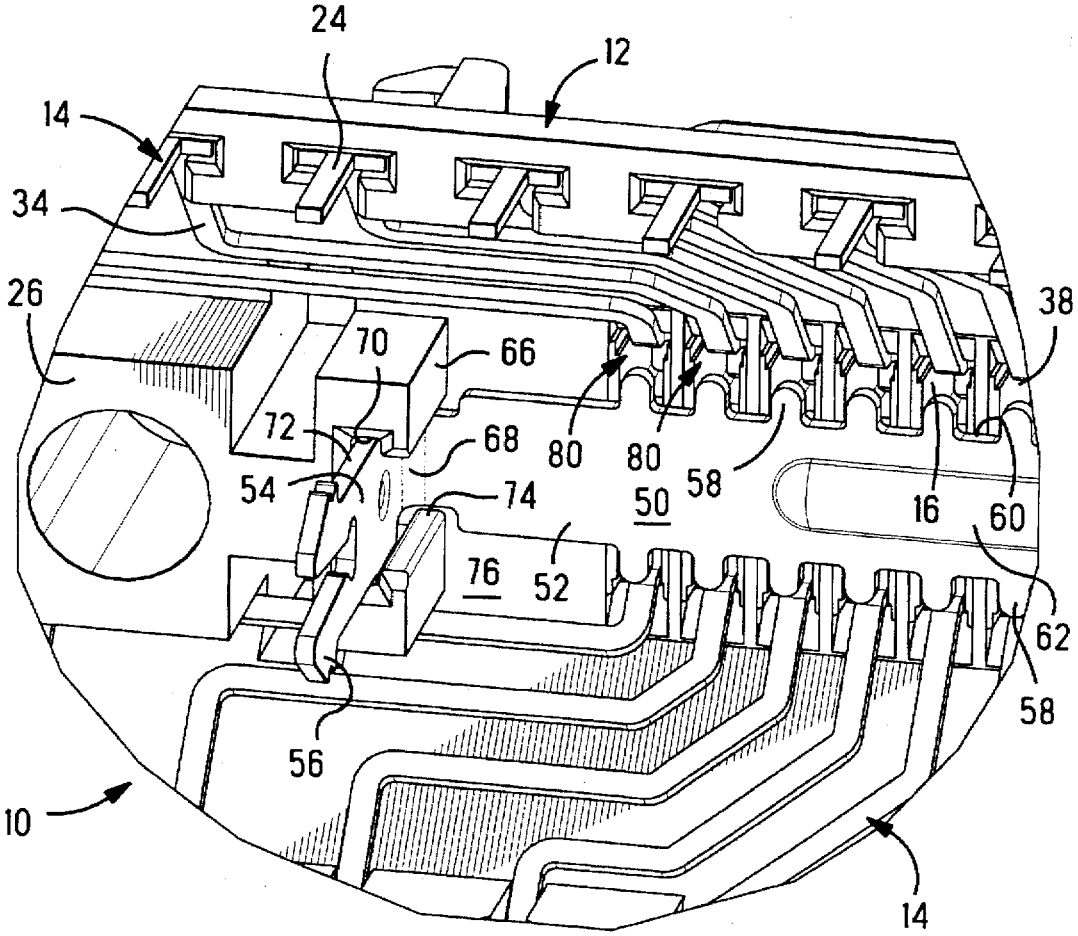

As seen best in FIG. 8, conductive body 52 extends past and near all contacts 14 along mounting face 26, with protrusions 58 associated with respective contacts 14 along body sections 34, such as at retention sections 38 exposed at entrances to passageways 16 of housing 12. A small finite distance is maintained at spark gap 80 between protrusions 58 and contacts 14, which distance may be incremental and just sufficient to assuredly not engage the contacts. If desired, a nonconductive or dielectric film or coating may be provided on either the contacts or conductive member 50 adjacent spark gap 80 which may then be sufficiently slit or perforated to allow metal to directly face metal to allow discharge of the electrostatic potential, with the film or coating sufficient to assuredly prevent engagement of the metal surfaces. Such coating may be an oxide layer on the conductive member, or may be a thin film of for example polyester or polytetrafluoroethylene. A spark gap may also be defined without protrusions being formed on the conductive member. It is seen that the conductive member of the present invention may easily be stamped and formed from a strip of metal such as tin-plated brass, and easily assembled to the connector housing.

Figure 6:
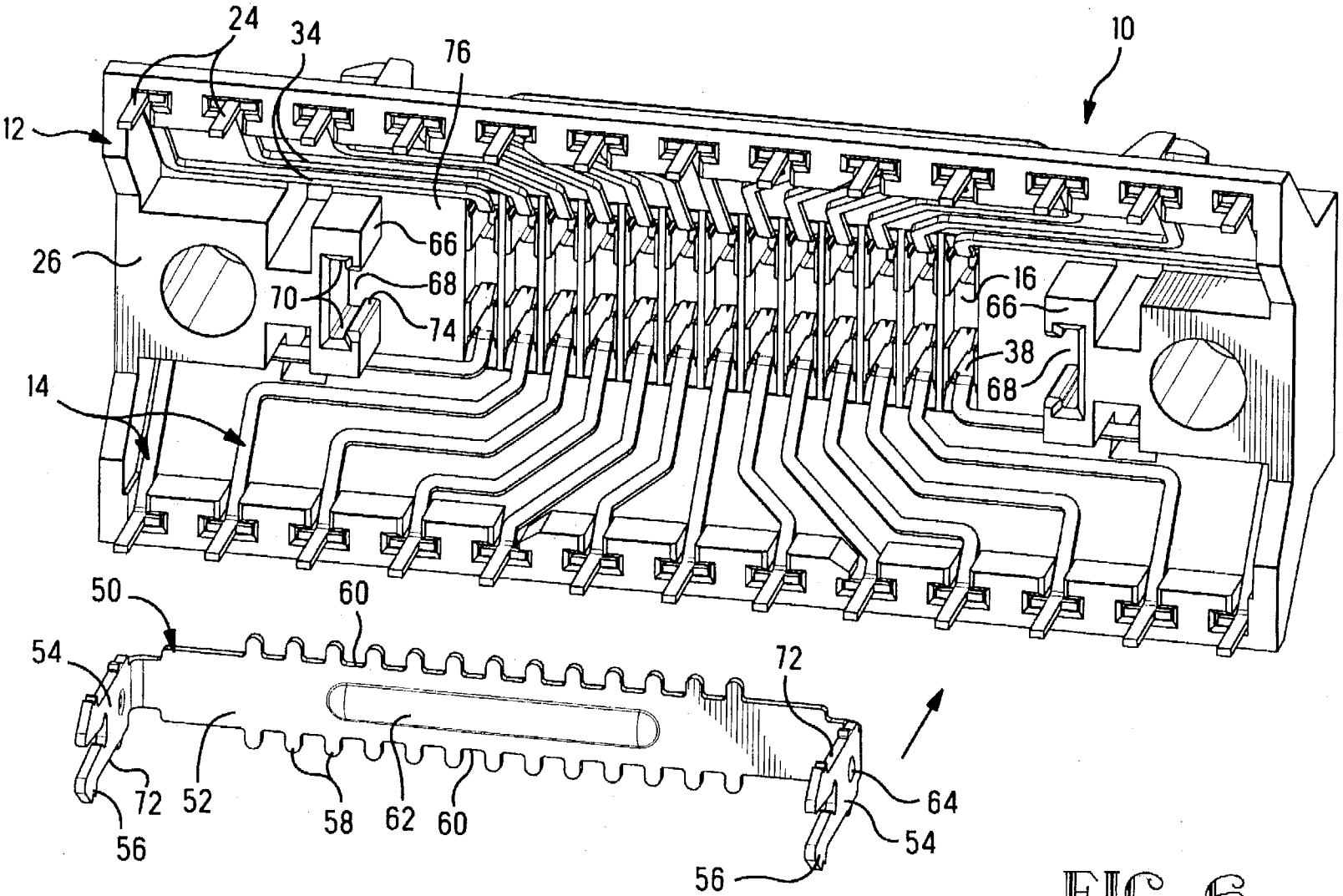
FIG. 6 is an isometric view of the board-mounting face of the connector with the conductive member of FIG. 3 positioned to be assembled thereto.
Figure 7:
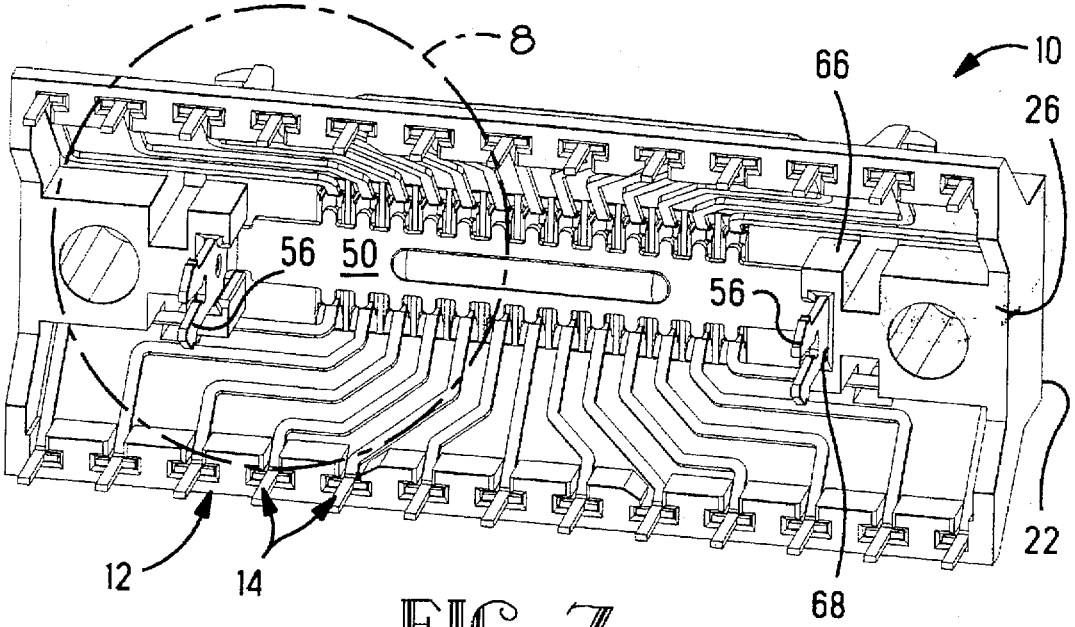
FIGS. 7 and 8 are isometric views of the board-mounting face of the connector, with FIG. 8 being an enlargement illustrating the board-mounting section of the conductive member of FIG. 3, and several spark gaps between the conductive member and several terminals of the connector.

FIGS. 6 to 8 illustrate that contacts 14 vary in shape and length along the intermediate portions of body sections 34 between widened portions 40 and retention sections 38 in order to provide a transition between the close spacing of contact sections 18 along mating face 22 and the relatively substantially spaced contact sections 24 along the mounting face 26 required of certain circuit elements such as circuit boards with stamped through holes. To facilitate assembly of the contacts in the housing, a clearing is provided between passageways 16 and the T-shaped slots 42 containing widened portions 40, preferably a flattened surface along which the intermediate portions of body sections 34 extend freely while being secured at widened portions 40 and retention sections 38.

The benefits of the present invention are especially useful where connector 10 is to be mounted to an electronic apparatus at an input/output port, to allow connection of an electrical cable of a peripheral electronic unit for signal transmission between the apparatus and the unit, a scenario commonly understood to generate electrostatic potential therebetween needing to be safely discharged. The present invention is continuously operative to discharge the potential after mating of the apparatus connector and the cable connector, unlike many ESD arrangements that are only operative at the instant of connector mating.

One aspect of the present invention is that the conductive member also contains the board-mounting portion of the connector simplifying assembly thereof and reducing the inventory of parts, where the board-mounting portion is grounded to a ground circuit of the circuit board. However, if desired, the conductive member may be separate from the board-mounting portion so long as a ground connection is established to chassis ground of the apparatus. Another advantage of the present invention is that ESD protection is provided in a connector with no shield therearound, when the connector is mounted at an input/output port of an apparatus and is in an unmated condition and thus susceptible to ESD from a variety of sources.

Other modifications and variations may be made to the embodiment of the present invention described herein, that are within the spirit of the invention and the scope of the claims.

What is claimed is:

1. An electrical connector, comprising an insulative housing having a mating face and a mounting face and a plurality of contacts extending therethrough having contact sections along both faces for electrical connection to respective other electrical articles, and further including a conductive member affixed along said mounting face, said conductive member having a body section including portions extending near exposed portions of all said contacts to define small gaps therebetween for discharge of electrostatic potential when the conductive portion is connected to chassis ground, and said conductive member further including at least two tab portions cooperating with respective tab-receiving slots of said housing in interference fit, whereby the conductive member assuredly self-retains to said mounting face of said housing.

2. The electrical connector as set forth in claim 1, wherein said conductive member body section includes protrusions extending from said body section toward said exposed contact portions.

3. The electrical connector as set forth in claim 1, wherein said conductive member includes tabs extending from said mounting face and including board-mounting sections to be received into mounting holes of a circuit element to affix said connector to said circuit element, whereby said conductive member inherently provides the board-mounting sections for said connector.

4. The electrical connector as set forth in claim 3, wherein rearward ends of said tabs are adapted to be received into slots of said housing during assembly of said conductive member thereto.

5. The electrical connector as set forth in claim 4, wherein said tabs are shaped and dimensioned to establish an interference fit within said slots to provide retention of said conductive member to said housing.

6. The electrical connector as set forth in claim 4, wherein said slots are defined into flanges of said housing and are in communication with an opening along said mounting face wherealong said exposed contact portions are disposed, such that upon assembly of said conductive member to said housing, said body section extends outwardly from said tabs and along said opening to extend past said exposed contact portions.

7. The electrical connector as set forth in claim 1, wherein said slots are defined into flanges of said housing and are in communication with an opening along said mounting face wherealong said exposed contact portions are disposed, such that upon assembly of said conductive member to said housing, said body section extends outwardly from said tabs and along said opening to extend past said exposed contact portions.

8. The electrical connector as set forth in claim 1, wherein said contacts are adapted to be inserted into respective passageways of said housing and establish an interference fit therewithin for contact retention in said housing.

9. The electrical connector as set forth in claim 8, wherein ones of said contact sections along said mounting face extend therefrom for being connected to circuits of a circuit element, said ones of said contact sections include widened portions between ends thereof and said interference fit of said contacts in said passageways, and said housing includes slots along said mounting face into which said widened portions are held against movement in a transverse direction thereby positioning said contact sections for said electrical connection to said circuits of said circuit element.

10. The electrical connector as set forth in claim 9 wherein said housing includes a clearing between said slots holding said widened portions and said interference fit of said contacts in said passageways, wherealong intermediate sections of said contacts extend, facilitating assembly of said contacts in said housing.

11. The electrical connector as set forth in claim 3 wherein said tabs extending from said mounting face are integral with said tab portions in interference fit within said tab-receiving slots of said housing.

* * * * *